US011591733B2

(12) United States Patent
Raffaele et al.

(10) Patent No.: US 11,591,733 B2
(45) Date of Patent: Feb. 28, 2023

(54) ASSEMBLIES FOR TEXTILE MANUFACTURING AND RELATED METHODS

(71) Applicant: NIKE, Inc., Beaverton, OR (US)

(72) Inventors: Guillermo Raffaele, Portland, OR (US); Haley L. Toelle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 12 days.

(21) Appl. No.: 16/383,299

(22) Filed: Apr. 12, 2019

(65) Prior Publication Data

US 2019/0316285 A1 Oct. 17, 2019

Related U.S. Application Data

(60) Provisional application No. 62/657,179, filed on Apr. 13, 2018.

(51) Int. Cl.
*D05C 9/04* (2006.01)
*D05C 3/02* (2006.01)

(52) U.S. Cl.
CPC ..... *D05C 9/04* (2013.01); *D05C 3/02* (2013.01)

(58) Field of Classification Search
CPC ... D05C 9/00; D05C 9/02; D05C 9/04; D05C 9/06; D05C 9/10; D05C 9/12; D05C 9/14; D05C 9/16; D03C 3/02; D05B 21/007; D05B 23/009; B24B 31/05; D06H 3/16
USPC ..... 223/75
See application file for complete search history.

(56) References Cited

U.S. PATENT DOCUMENTS 905,247 A 12/1908 Swoboda
1,583,590 A * 5/1926 Gray ..... D06C 5/005 223/76
2,330,757 A * 9/1943 Stout ..... D06C 5/005 223/76

(Continued)

FOREIGN PATENT DOCUMENTS

CN 101525818 A 9/2009
CN 107630299 A 1/2018

(Continued)

OTHER PUBLICATIONS

Actuate, Merriam-Webster, https://www.merriam-webster.com/dictionary/actuate, (last visited Jun. 8, 2021) (Year: 2021).*

(Continued)

*Primary Examiner* — Alissa L Hoey
*Assistant Examiner* — Patrick J. Lynch
(74) *Attorney, Agent, or Firm* — Shook, Hardy & Bacon L.L.P.

(57) ABSTRACT

One general aspect of the present disclosure includes an assembly including: a support device having a surface for receiving a textile component; and an actuation device, the actuation device having at least one actuation surface that at least partially surrounds the support device, where the actuation surface is movable with respect to the surface of the support device such that, when the textile component is held by the support device, movement of the actuation surface with respect to the surface of the support device causes movement of the textile component with respect to the surface of the support device.

17 Claims, 7 Drawing Sheets

(56) References Cited

U.S. PATENT DOCUMENTS 3,050,106 A * 8/1962 Pusch ..... B31F 1/0064 156/457
3,129,535 A * 4/1964 Slattery ..... E01B 31/175 451/57
3,395,044 A * 7/1968 Shoeld ..... H01M 10/125 429/94
3,687,426 A * 8/1972 Bandel ..... B29C 59/04 432/59
4,099,401 A * 7/1978 Hug ..... H01M 10/0409 72/147
4,509,666 A * 4/1985 Rosso ..... D06G 3/02 223/39
4,611,733 A * 9/1986 Nishikawa ..... D06H 3/16 223/111
4,691,400 A * 9/1987 Arneson ..... A47L 21/02 15/210.1
5,383,410 A * 1/1995 Mukai ..... D05B 33/00 112/143
5,553,560 A 9/1996 Tajima et al.
5,564,609 A * 10/1996 Tsuchiya ..... D05B 23/008 112/470.15
5,642,601 A * 7/1997 Thompson, Jr. ..... B65B 63/02 428/921
5,768,756 A * 6/1998 Noelle ..... D04H 18/04 28/104
6,913,173 B2 * 7/2005 Manini ..... D06C 5/005 223/75
7,748,332 B2 * 7/2010 Lonati ..... D06C 5/005 112/475.12
2004/0108343 A1 * 6/2004 Bagni ..... D06H 3/16 223/75
2012/0167810 A1 * 7/2012 Fujiura ..... D05C 9/06 112/103
2013/0029827 A1 * 1/2013 Fujita ..... A61F 13/15585 493/405
2013/0199428 A1 * 8/2013 Savoldi ..... D05C 9/06 112/103
2014/0352591 A1 * 12/2014 Makover ..... D05B 27/10 112/470.18
2015/0240401 A1 * 8/2015 Kobayashi ..... D05C 9/06 112/102.5
2015/0307116 A1 * 10/2015 Naidu ..... B61L 3/227 246/3

FOREIGN PATENT DOCUMENTS

DE 102009041177 A1 * 3/2011 ..... B29C 70/32
EP 0 621 363 A1 10/1994
GB 2 138 044 A 10/1984
WO WO-2013038999 A1 * 3/2013 ..... A61F 2/89

OTHER PUBLICATIONS

International Search Report and Written Opinion dated Jul. 25, 2019 for PCT Application No. PCT/US2019/026900 (11 pp.).
Intention to Grant received for European Patent Application No. 19721440.6, dated Sep. 6, 2021, 5 pages.
Extended European Search Report received for European Patent Application No. 22153144.5, dated Jun. 22, 2022, 8 pages.

* cited by examiner

ASSEMBLIES FOR TEXTILE MANUFACTURING AND RELATED METHODS

RELATED APPLICATION

This application claims the benefit of U.S. Provisional Application No. 62/657,179, filed Apr. 13, 2018, which is hereby incorporated by reference in its entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines.

In some applications, the textile may be embroidered with at least one embroidery element, such as a strand, thread, yarn, or the like (herein referred to as a "strand" when referring to an embroidered element). The embroidery process may be accomplished on a mechanical device called an embroidery machine. Typically, an embroidery machine includes a needle for mechanically manipulating the strand through the base layer of the textile. Usually, the embroidery process occurs after the base layer of the textile is formed, and the embroidery machine is typically separate from the machine used to form the base textile layer (e.g., a knitting machine or a weaving loom).

While embroidery machines have been used with success for certain applications, one shortcoming of existing machines involves the limited motion of the embroidery needle. For example, existing embroidery needles are movable vertically and/or in a horizontal plane, but they cannot rotate or otherwise change the orientation of their vertical axes. This shortcoming has limited the usefulness of embroidery machines with respect to certain types of textiles, and particularly textiles with a tubular construction and/or curved areas. In particular, embroidery machines of the type described above cannot reach all areas of a tubular or curved textile without human intervention (e.g., through repositioning the textile during the embroidery process). The embodiments described below provide an improved device for overcoming this shortcoming.

BRIEF DESCRIPTION OF THE DRAWINGS

The invention can be better understood with reference to the following drawings/figures and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
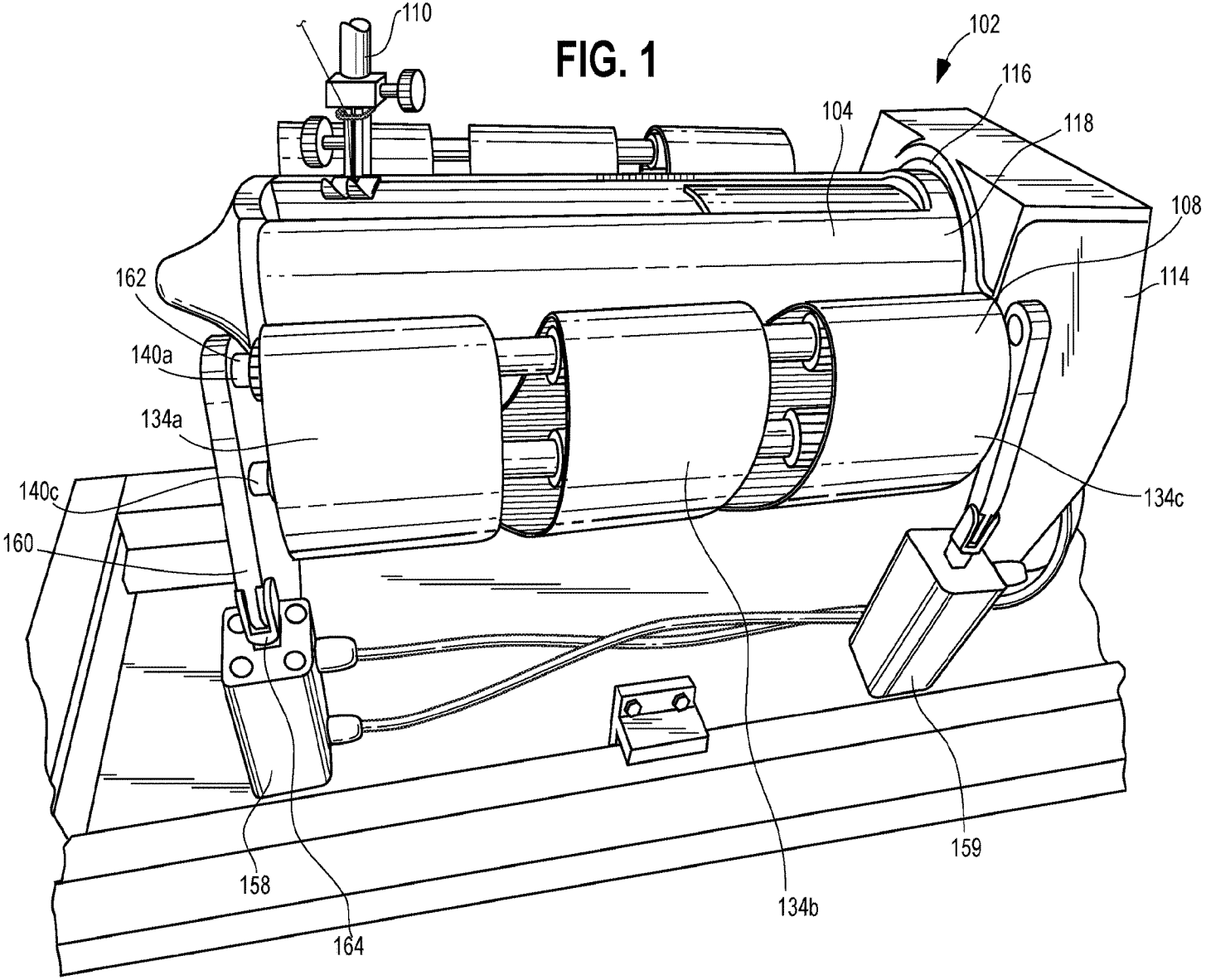
FIG. 1 is an illustration showing an assembly for an embroidery machine in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

One general aspect of the present disclosure includes an assembly including: a support device having a surface for receiving a textile component; and an actuation device, the actuation device having at least one actuation surface that at least partially surrounds the support device, where the actuation surface is movable with respect to the surface of the support device such that, when the textile component is held by the support device, movement of the actuation surface with respect to the surface of the support device causes movement of the textile component with respect to the surface of the support device.

Another general aspect of the present disclosure includes an assembly, including: a actuation device, the actuation device having at least one belt defining an actuation surface that is movable with respect to an outer surface of a support device, where the actuation device has an engaged state and an open state, where the actuation surface at least partially surrounds the support device when in the engaged state, and where at least a portion of the actuation surface moves away from the support device when transitioning from the engaged state to the open state.

Another general aspect of the present disclosure includes a method, the method including: placing a textile component on a surface of a support device; placing the support device into engagement with an actuation device, the actuation device having at least one actuation surface that at least partially surrounds the support device; and moving the textile component with respect to the support device by moving the actuation surface while the actuation surface is engaged with the textile component.

Another general aspect of the present disclosure includes a textile component, including: a tubular construction forming a textile layer that defines and surrounds an inner opening; and an embroidered strand, where the embroidered strand extends at least 360 degrees around the tubular construction of the textile component.

FIG. 1 is an illustration showing an assembly 102 for an embroidery machine. The embroidery machine may be any suitable manufacturing device for embroidering a strand or other material within a textile, and one example (for illustration purposes) is a single or multi-head embroidery machine sold by Barudan America Inc. of Solon, Ohio. The embroidery machine may include an embroidery needle 110 for placing an embroidery element, such as the depicted strand 204, on or through a base layer of a textile component 202. In particular, the embroidery needle 110 may lock the strand 204 to the textile component 202 by stitching the strand 204 to and/or through the textile structure of textile component 202 (e.g., through the use of satin-stitches, running-stitches, fill-stitches, or the like). Each stitch may utilize a lock-stitch or other suitable structure to enhance securement of the strand 204 to the textile component 202.

The assembly 102 may be separate from the embroidery machine (as shown), or alternatively it may be built as a portion of the embroidery machine. The assembly 102 may generally include a support device 104 for holding a textile component 202 and an actuation device 108 for moving (e.g., rotating) the textile component 202. A housing 114 of the assembly 102 (which may be fixed to the embroidery machine) may have a connection port 116 that connects to the first end 118 of the support device 104. The connection port 116 may include a socket, a flange, a series of connection holes (e.g., for bolting or screwing), a clamp, etc. The connection port 116 may couple to the support device 104 in a permanent or non-permanent manner. In some embodiments, the support device 104 may be fixed to the embroidery machine through the port 116. Herein, "fixed to" means "rigidly attached to" in a permanent or non-permanent manner. Similarly, the actuation device 108 may be fixed to or otherwise coupled to the embroidery machine, but it is also contemplated that the actuation device 108 may simply be placed adjacent to the embroidery machine in an appropriate location for communication with the embroidery machine.

Figure 2:
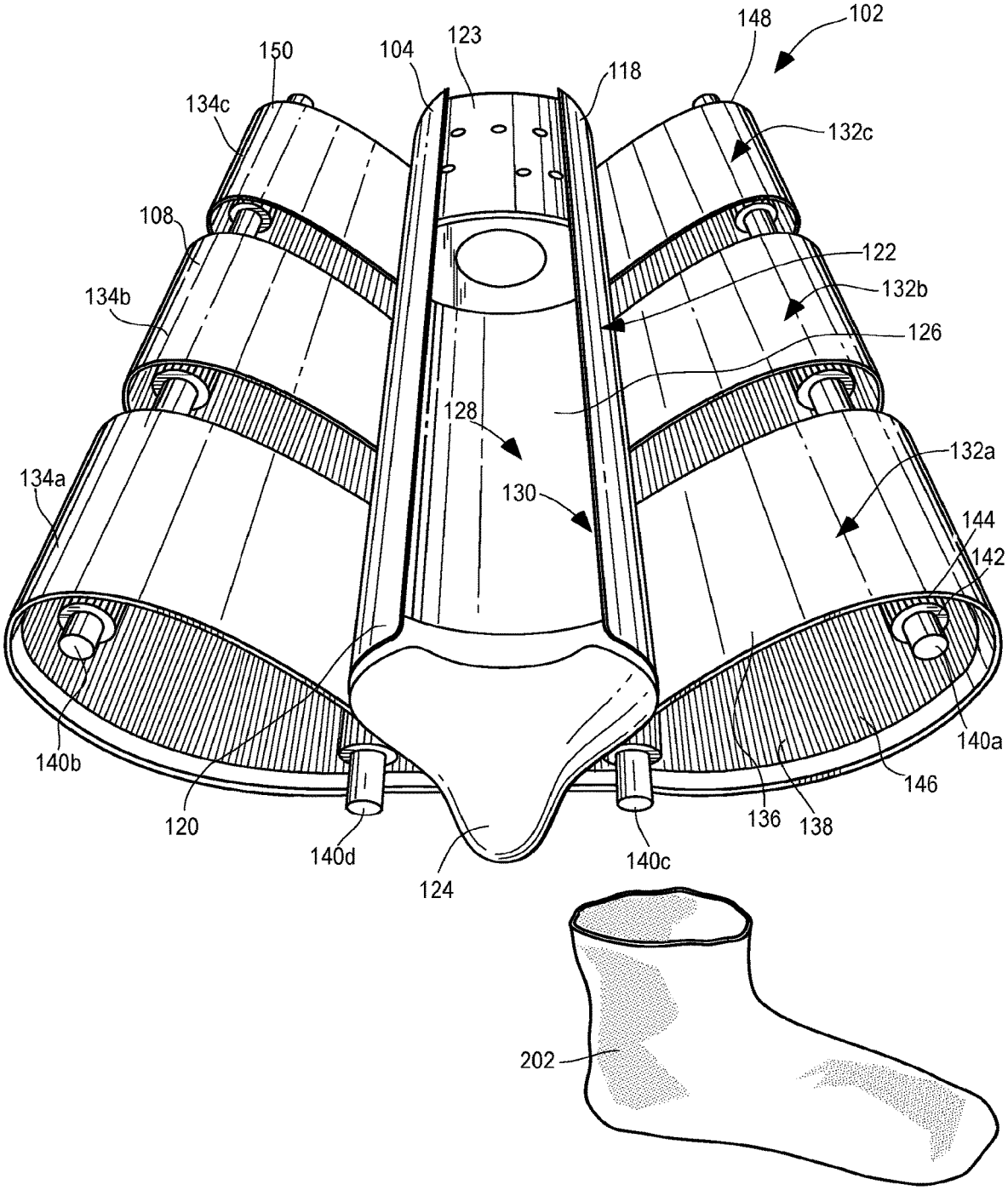
FIG. 2 is an illustration showing a support device and actuation device of the assembly of FIG. 1, where the actuation device is in an open state in accordance with certain aspects of the present disclosure.

FIG. 2 is an illustration showing certain components of the assembly of FIG. 1, including the support device 104 and the actuation device 108. The textile component 202 is shown prior to placement on the support device 104. Referring to FIG. 2, the first end 118 of the support device 104 may have a connection adapter 123 for cooperation with the connection port 116 (FIG. 1) of the assembly 102. A second end 120 of the support device 104 may include an optional nose element 124. The nose element 124 may be advantageous for facilitating the placement of the textile component 202 on the support device 104 by preventing snagging, by progressively stretching the textile component 202 (if necessary), and/or by otherwise guiding the textile component around an outer surface 122 of the support device 104 during deployment.

The support device 104 may be cylindrical in shape, which is particularly advantageous when the textile component 202 is tubular in shape. For example, the textile component 202 may be a circular-knit tubular configuration for use in a variety of applications (e.g., a sock, a glove, a portion of an article of footwear, a portion of an article of apparel, an industrial tubular component, a stent, etc.). Other types of textiles are also contemplated, including non-tubular textiles (e.g., flat-knit textiles, flat-woven articles, etc.). Thus, it is contemplated that the support device 104 may be flat or have another suitable shape that corresponds to textiles having a variety of shapes, curvatures, sizes, etc. For simplicity, the support device 104 will be described as being generally cylindrical in the remainder of this description.

The outer surface 122 of the support device may be configured (e.g., sized, shaped, and positioned) to receive the textile component 202, and also to contact and support an inner surface of the tubular textile component 202 upon receipt. For example, the outer surface 122 of the support device 104 may have a diameter that is about the same size as, or slightly larger than, the inner diameter of the textile component 202 when the textile component 202 is in a relaxed state. In other embodiments, the diameter of the outer surface 122 may be substantially larger than (e.g., at least 10% larger than) the inner diameter of the relaxed textile component 202 such that the textile component 202 is slightly or substantially stretched when deployed on the support device 104. This may be advantageous when a stretched orientation is desirable during embroidery.

An opening or window 126 may be present and extend through at least a portion of the outer surface 122 to provide access to a space or cavity 128, and the cavity 128 may be defined by an inner surface 130 of the support device 104. The window 126 and cavity 128 are advantageous for providing room for the embroidery needle 110 (FIG. 1) to operate. For example, when the embroidery needle 110 (FIG. 1) functions by extending a strand or other element back and forth through a base surface of the textile component 202, the window 126 may be positioned immediately beneath the embroidery needle such that the embroidery needle avoids contact with the outer surface 122 of the support device 104, and instead extends into the cavity 128, when it pierces the textile component 202. Other constructions of the support device 104 are also contemplated to achieve a similar effect (see, e.g., FIGS. 6-7).

The actuation device 108 may include at least one actuation surface 132 (where "132" collectively represents the actuation surfaces 132*a*, 132*b*, and 132*c*). The actuation surfaces 132 may at least partially surround the support device 104. In the depicted embodiment, three actuation surfaces 132 are included: a first actuation surface 132*a*, a second actuation surface 132*b*, and a third actuation surface 132*c*. Other embodiments may have fewer (e.g., one or two) or more (e.g., four, five, or more) actuation surfaces 132. The actuation surfaces 132 may be movable with respect to the outer surface 122 of the support device 104. For example, the first actuation surface 132*a* may be a surface of a first belt 134*a*, and the first belt 134*a* may be capable of rotating or otherwise cycling such that the first actuation surface 132*a* moves with respect to the outer surface 122 of the support device 104. Similarly, the second actuation surface 132*b* may be a surface on a second belt 134*b*, and the third actuation surface 132*c* may be a surface on a third belt 134*c*. More or fewer than three belts 132 may be included (where "132" collectively represents the belts 132*a*, 132*b*, and 132*c*).

The actuation surfaces 132*a* of the first belt 134*a* may be located on a first face 136 of the first belt 134*a*, and a second face 138 of the first belt 134*a* (opposite the first face 136) may be mechanically coupled to at least one shaft 140 (where "140" represents the shafts 140*a*, 140*b*, 140*c*, and 140*d*). Four shafts may be included: a first shaft 140*a*, a second shaft 140*b*, a third shaft 140*c*, and/or a fourth shaft 140*d*. At least one of the shafts 140 may include idler-wheels 142 for transmitting the rotation of the shafts 140 into rotation or other cycling motion of the belts 134. To enhance these transmissions, the second face 138 of the first belt

134*a* may include grooves 146 that communicate with a set of projections 144 extending from the idler-wheels 142. In other words, to avoid slippage, the projections 144 of the idler-wheels 142 may be received by the grooves 146 on the second face 138 of the first belt 134*a*. As a result, as the first shaft 140*a* rotates, the first belt 134*a* will cycle. The second belt 134*b* and the third belt 134*c* may also, or alternatively, include grooves and thus also cycle when the shafts 140 rotate.

In the depicted embodiment, the four shafts 140 include two top shafts (e.g., the first shaft 140*a* and the second shaft 140*b*) and two bottom shafts (the third shaft 140*c* and the fourth shaft 140*d*). More particularly, the first shaft 140*a* and the second shaft 140*b* are located on in a first plane (e.g., a plane that is horizontal) and the third shaft 140*c* and the fourth shaft 140*d* are located in a lower second plane. The first shaft 140*a* and the third shaft 140*c* are located on a right side 148 of the actuation device 108 (from the perspective of FIG. 2), and similarly the second shaft 140*b* and the fourth shaft 140*d* are located on a left side 150 of the actuation device 108 (from the perspective of FIG. 2). While other locations and/or orientations are also possible, these particular locations of the shafts 140 may be advantageous for ensuring the support device 104 is adequately surrounded by the actuation surfaces 132 while still providing the embroidery needle with access to the window 126 from above.

The shafts 140 may be driven (i.e., forced into rotation) through any suitable device or method. For example, at least one of the shafts 140 may be coupled to a motor. If only one motor is included, the motor may be coupled to only one of the shafts 140 or to multiple shafts 140 (e.g., through a chain or belt drive). In other embodiments, more than one motor may be included (e.g., certain shafts 140 may be associated with separate motors). Herein, a shaft 140 that is mechanically coupled to a motor (or other rotation-effecting actuator) through something other than the belts 134 themselves is referred to as a "driven shaft." For example, in some non-limiting exemplary embodiments, at least one of the bottom shafts 140*c*, 140*d* may be a driven shaft, but the top shafts 140*a*, 140*b* may not be. As a result, rotation of the first shaft 140*a* and the second shaft 140*b* may be determined solely by motion of the belts 134. This embodiment may be advantageous for allowing the first shaft 140*a* and the second shaft 140*b* to be horizontally/vertically movable, as described in more detail below.

Figure 3:
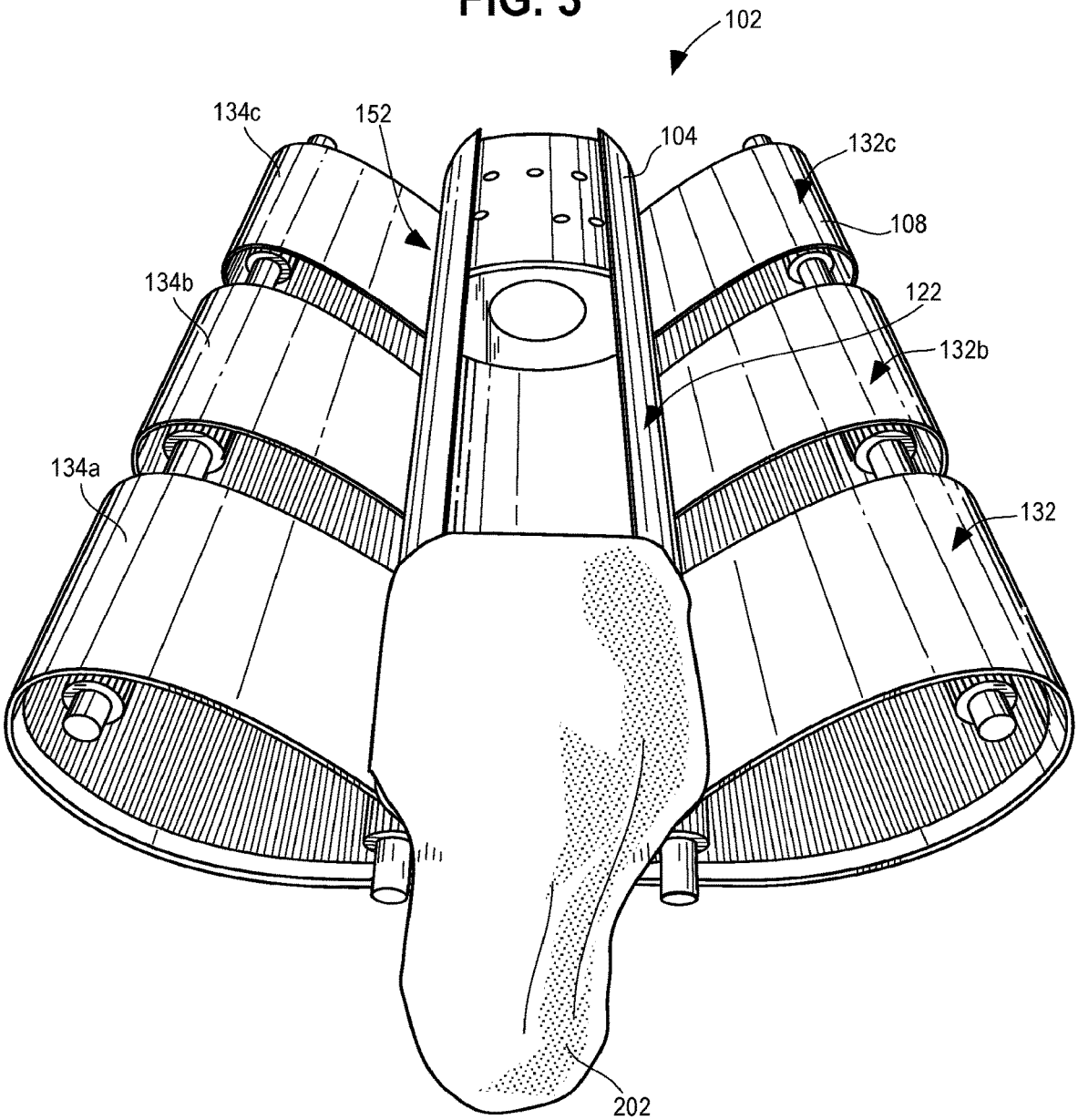
FIG. 3 is an illustration showing the support device and the actuation device of FIG. 2, where a textile component is partially deployed on the support device in accordance with certain aspects of the present disclosure.

FIG. 3 is an illustration showing the assembly 102, where the textile component 202 is partially deployed on the support device 104. The task of placing the textile component 202 on the support device 104 may be performed automatically or by a human operator. As shown, the textile component 202 may be placed on the support device 104 while the actuation device 108 is in an open state (and see FIG. 4 for an alternative closed state). In the depicted open state, a gap 152 may be located between the actuation surfaces 132 and the support device 104 to provide room for the textile component 202 to slide over the outer surface 122 of the support device 104 during deployment. In other embodiments, the gap 152 may not be provided, but the belts 134 may be loose enough and/or compliant enough such that the operator can force the belts 134 out of the way as the textile component 202 is deployed over and around outer surface 122 of the support device 104.

Figure 4:
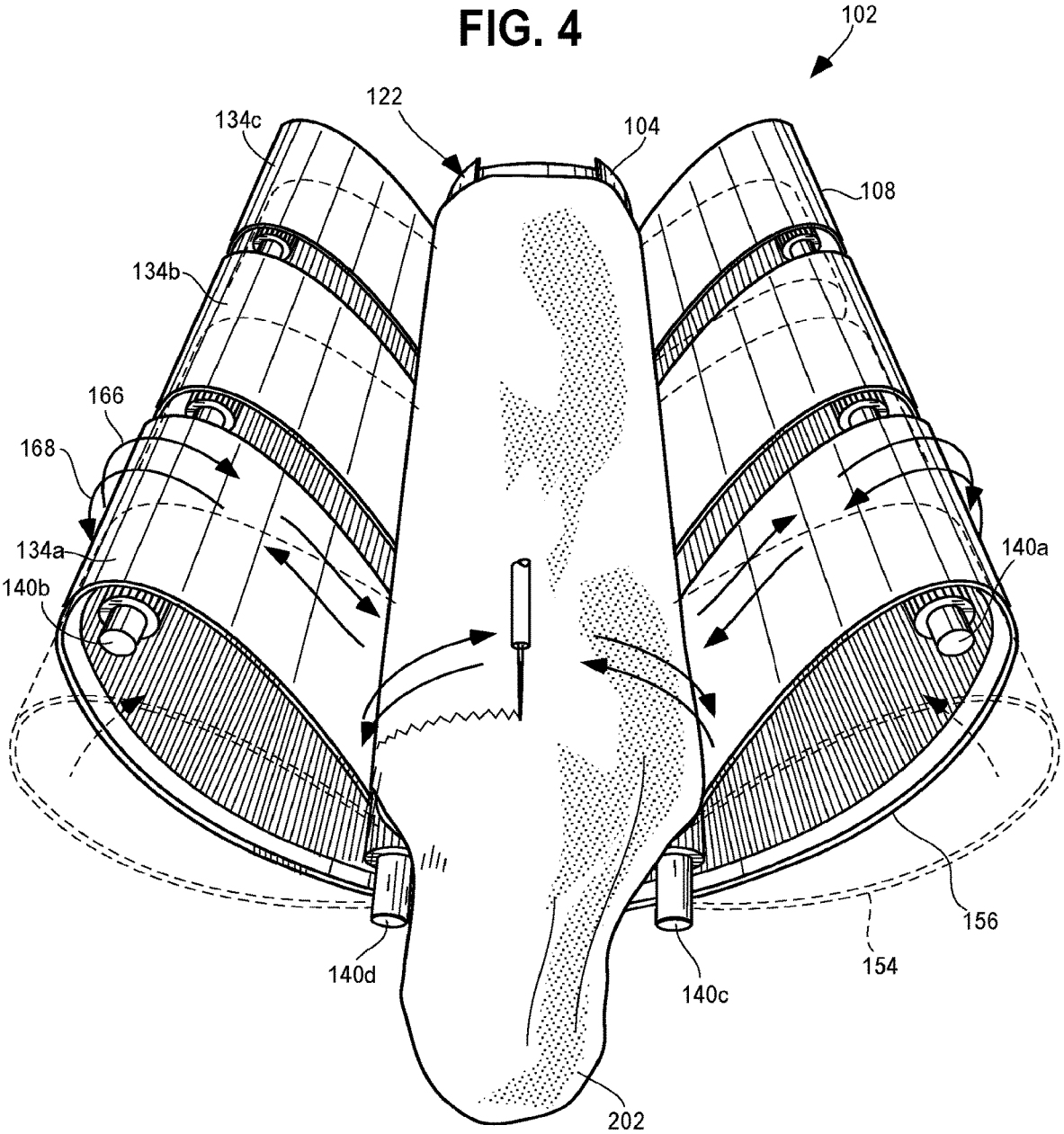
FIG. 4 is an illustration showing the support device and actuation device of FIG. 2 and FIG. 3, where the textile component is fully deployed on the support device, and where the actuation device has transitioned from the open state to a closed state in accordance with certain aspects of the present disclosure.

FIG. 4 is an illustration showing the assembly 102 where the textile component 202 is fully deployed on the support device 104, and where actuation device 108 has transitioned from the open state (FIG. 3) to a closed state. The closed state is also referred to as an "engaged state." In particular, the belts 134 may have two positions (or more): a first position 154 shown in more detail in FIG. 3 corresponding to the open state, and a second position 156 as detailed in FIG. 4 corresponding to the closed state. In the closed state, the first shaft 140*a* and the second shaft 140*b* may be displaced upwards and inwards (perhaps along a rotational path), thereby at least partially wrapping the belts 134 around the support device 104. An embroidery needle can still access the textile component 202 from above in the closed state. The third shaft 140*c* and the fourth shaft 140*d* may also move, but in other embodiments, the third shaft 140*c* and the fourth shaft 140*d* may remain in the same respective positions in both the open and closed states, particularly when they are coupled to one or more immovable actuators (e.g., motors).

One embodiment for providing control of the shaft position is shown in FIG. 1. As shown there, the shafts 140*a* and 140*c* may be coupled to a linear actuator 158 (or another suitable actuation device) through a linkage 160. The linkage 160 may also provide support to an end 162 of the shafts 140*a* and 140*c*, and the shafts 140*a* and 140*c* may be rotatable with respect to the linkage 160 about their respective longitudinal axes. The linkage 160 is also optionally rotatable with respect to an actuation arm 164 of the linear actuator 158. When the actuation arm 164 of the linear actuator 158 extends upward, it may force the linkage 160 upward, which will also force the shafts 140*a* and 140*c* upward. As a result, the shafts 140*a* and 140*c* will reposition a portion of the belts 134 such that the belts 134 are partially wrapped and tensioned around the support device 104. This tension in the belts 134 may provide sufficient engagement between the actuation surfaces 132 and a textile component held on the support device 104, as described above.

In the depicted embodiment, the linkage 160 is coupled to the first shaft 140*a* and the third shaft 140*c*. In other embodiments, the lower shafts (i.e., the third shaft 140*c* and fourth shaft 140*d*) may not be directly secured to the linkages 160, and therefore they may not move when the linkages 160 move. This may be advantageous when the lower shafts 140*c*, and 140*d* are drive shafts that are coupled to a motor or other actuator, since a common location among different states (e.g. open and closed states) prevents the need to also move the associated motor or other actuator with the drive shafts.

The degree of extension of the actuation arm 164 may also be variable, which may allow for one or more intermediate states between the open state and the closed state. As a result, the actuation device 108 may be capable of adapting to two or more different support devices 104 having different dimensions, and/or different belts 134. Optionally, more than one linear actuator 158 may be included. For example, a second linear actuator 159 may be included to assist with shaft positioning. While not visible in FIG. 1, one or more linear actuators may be included on the other side of the assembly 102 and coupled to one or more of the second shaft 140*b* and the fourth shaft 140*d* through separate linkages. The linear actuator(s) may be controlled automatically (e.g., via a control device) or manually (e.g., by pushing a button to activate the linear actuator, or by manually forcing the actuation arm 164 vertically).

Referring to FIG. 4, the closed state provides suitable contact or other engagement, and therefore friction, between the actuation surfaces 132 and the textile component 202. In the closed state, the total static friction between the actuation surfaces 132 and the textile component 202 may be greater than the total static friction between the outer surface 122 of the support device 104 and the textile component 202. As a result, when the actuation surfaces 132 move, the textile component 202 may remain static (i.e., substantially lacking relative motion) with respect to the actuation surfaces 132, but will slip and therefore rotate with respect to the outer surface 122 of the support device 104. Rotation/cycling of the belts 134 will therefore cause rotation of the textile component 202 with respect to the embroidery machine.

The ability to rotate of the textile component 202 may provide an embroidery needle with access to areas of the textile component 202 that would not otherwise be reachable if the textile component 202 was stationary. To illustrate, in current systems, embroidery needles can typically only move vertically and axially, and they cannot rotate around a tubular textile component to gain access to locations 360 degrees around the entirety of the textile surface. The present embodiments overcome this shortcoming by providing an apparatus and method that is capable of moving/rotating the textile with respect to the embroidery needle, and therefore providing 360 degree access to surfaces of the textile. Notably, this 360 degree access is provided without necessitating human intervention during the embroidery process and without additional machine-setup steps (and therefore without substantially compromising manufacturing efficiency).

Another advantage of the assembly 102 is the capability of multi-directional rotation. Referring to FIG. 4, the belts 134 may be capable of cycling in a first direction 166 and also a second direction 168. Switching the direction of rotation may be accomplished by switching the direction of rotation of the driven shaft(s), and/or by switching which shaft 140 provides the driving force. For example, if one motor is used (or multiple motors are operating in parallel), the direction of rotation may be switched by simply changing the direction of motor rotation. In other embodiments, one of the shafts 140 may be coupled to a first motor configured to drive rotation in the first direction 166, and a different one of the shafts 140 may be coupled to a different motor configured to drive rotation in the second direction 168. Thus, switching the direction of rotation may be accomplished simply by switching which motor provides the driving force (e.g., by turning one motor off and activating another). Advantageously, these embodiments may prevent the need for a multi-directional motor, which may decrease the complexity of the control system and reduce the expense of the assembly 102.

The rotation direction may be switched during the embroidery process, which allows the formation of zig-zag patterns and other patterns where the embroidered strand 204 varies in its stitch direction. This may provide the capability of creating complex embroidery patterns through controlling rotation of the textile component 202 while simultaneously controlling the operation of the embroidery needle. The assembly 102 may be automatically controlled (e.g., through a programmed control system) and/or manually controlled (through an interface providing control capabilities to a human operator). If automatically controlled, the same control system may operate both the embroidery needle and the assembly 102, or separate control systems may be used.

Figure 5:
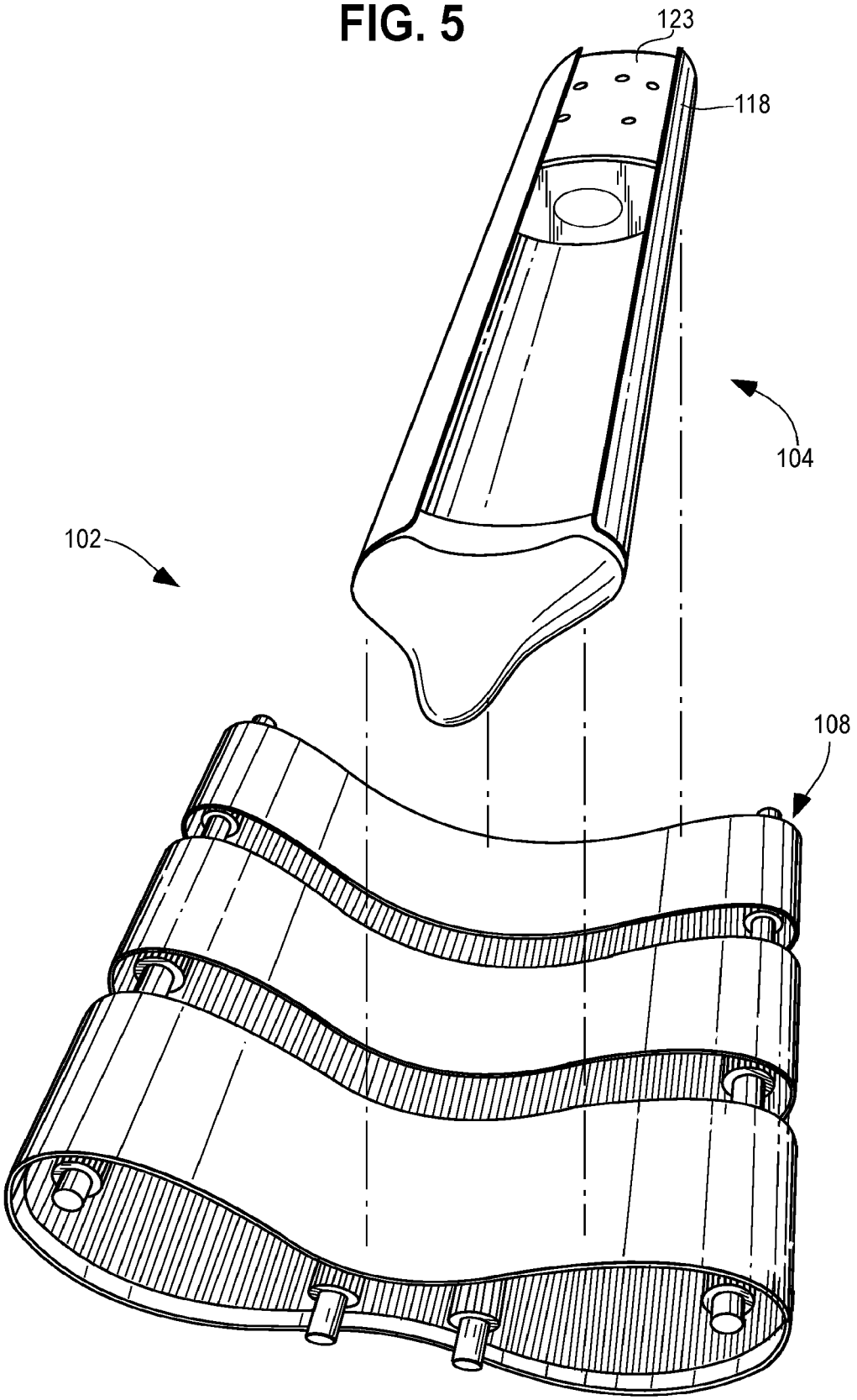
FIG. 5 is an illustration showing the support device and the actuation device of the assembly of FIGS. 1-4 in a disassembled state in accordance with certain aspects of the present embodiments.

Referring to FIG. 5, in some embodiments, the support device 104 may be separable from the actuation device 108. The first end 118 of the support device 104 may include the connection adapter 123 that connects to the assembly's port 116 (see FIG. 1). The connection adapter 123 may be removable from the port 116 (FIG. 1) such that the support device 104 can be handled independently. In certain embodiments, the connection adapter 123 may also be configured to attach to another textile manufacturing machine. Advantageously, the support device 104 may therefore be movable to another manufacturing process while retaining a textile component. For example, a heat-application device (not shown) may also include a port for receiving the connection adapter 123, and the textile component may therefore be moved from the embroidery machine to the heat application device, and then heat-treated, while under continuous support provided by the support device 104. It is also noted that an operator may place the textile component on the support device 104 while the support device 104 is separated from the actuation device 108, and then move the support device 104 into engagement with the actuation device 108. This may be a preferred method when it is difficult to place the textile component on the support device 104 when engaged with the actuation device 108, even when/if the actuation device 108 is in the above-described open state.

The present embodiments also provide the assembly 100 with the ability to efficiently switch between different support devices 104. For example, different support devices 104 may have different dimensions (e.g., diameter, length, etc.) for receiving different sized textile components. Since the support devices 104 may have an identical or similar connection adapter 123, a certain support device 104 may be quickly and efficiently selected and placed into communication with the remainder of the assembly 102 without substantially adjusting anything else.

Figure 6:
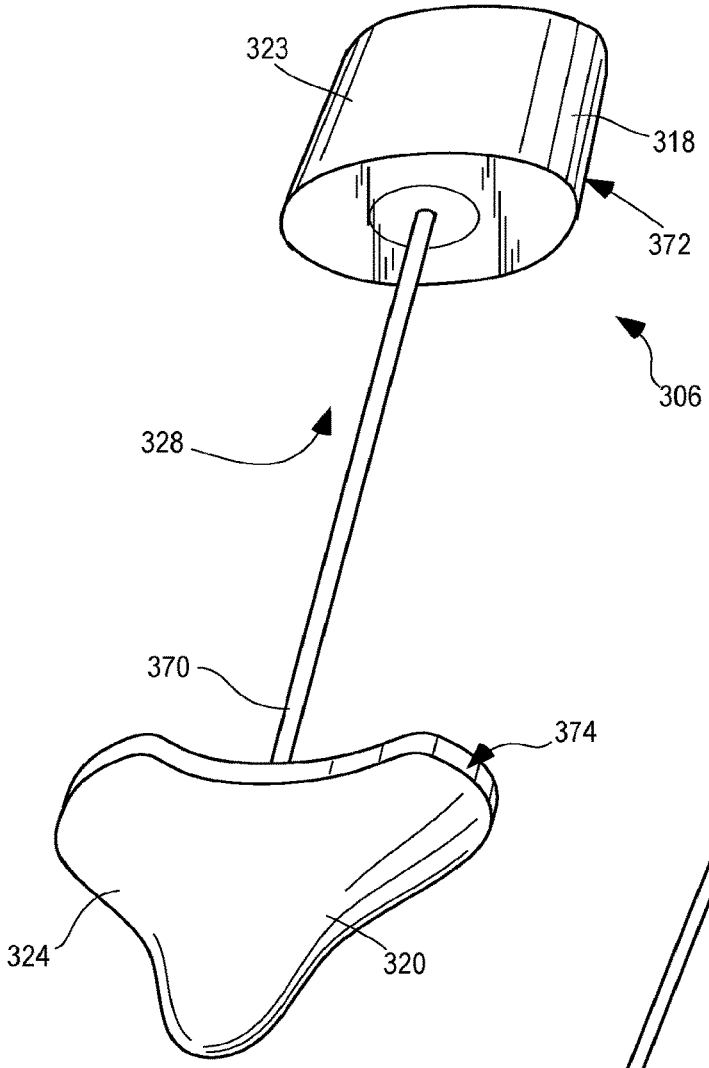
FIG. 6 and FIG. 7 are illustrations showing additional embodiments of a support device in accordance with certain aspects of the present disclosure.
Figure 7:
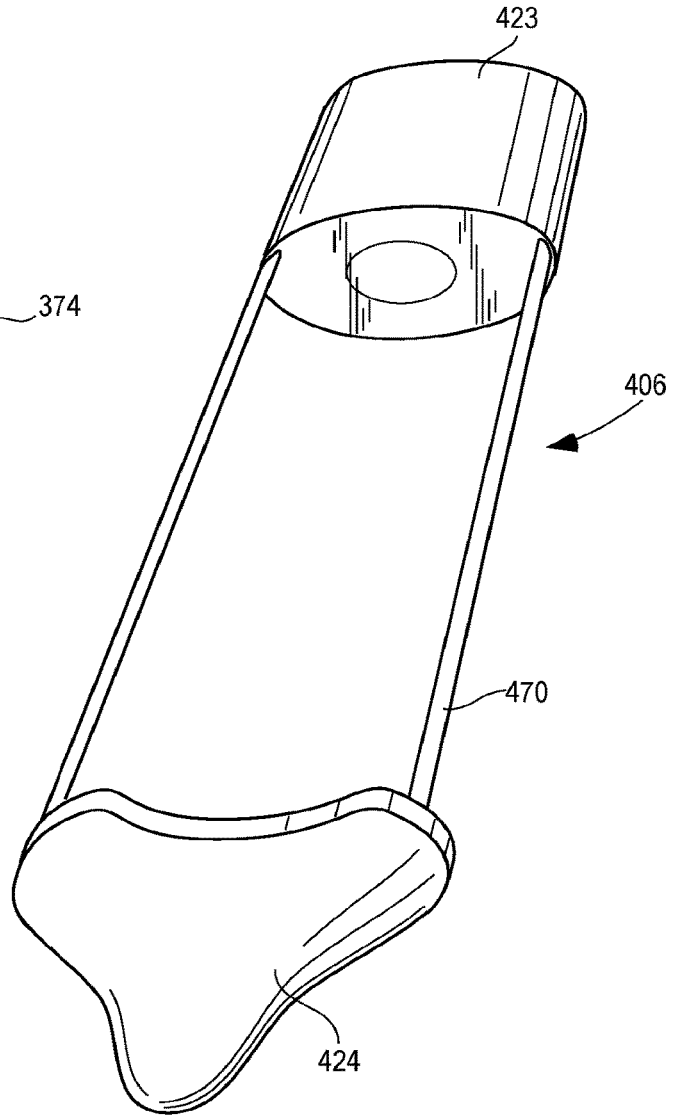

FIG. 6 and FIG. 7 are illustrations showing additional embodiments of support devices for use with the assembly 102 described above. For example, referring to FIG. 6, a support device 306 may include a central support shaft 370 that extends from a first end 318 to a second end 320. The central support shaft 370 may couple a connection adapter 323 to a nose element 324. The connection adapter 323 may be similar to the connection adapter 123 (of FIG. 2), and thus it is contemplated that the port 116 (FIG. 1) may be capable of receiving both support-device types. Still referring to FIG. 6, when a textile component is deployed over the nose element 324 and extends to the connection adapter 323, the central support shaft 370 may be spaced from the textile component 202 since it is radially separated from an outer-diameter surface 374 of the nose element 324 and also from an outer-diameter surface 372 of the connection adapter 323. A gap or cavity 328 may therefore be defined between the textile component and the central support shaft 370 when the textile component is deployed, and the gap or cavity 328 may provide the requisite space needed for communication with an embroidery needle.

The embodiment of FIG. 6 may further be advantageous since the support device 104 itself could rotate with respect to an embroidery needle, which may provide rotation of a textile component with respect to an embroidery needle without using the actuation device 108 (of FIG. 1). For example, it is contemplated that the port 116 (FIG. 1) may rotate with respect to the remainder of the machine, thereby causing the support device 104 to rotate. The lack of any support device near or in contact with the textile component 202 along the majority of the length of the support device 104 may make this feasible since there will be nothing lining the inner surface of the textile component that may contact the embroidery needle to interfere with its operation.

FIG. 7 shows another embodiment of a support device 406, where a nose element 424 is connected to a connection adapter 423 via support shafts 470 located at or near the outer diameter of the support device 406. This embodiment may be advantageous since the support shafts 470 may provide support and/or tension to the textile component along its length (e.g., through direct contact), particularly when it is desirable for the textile component to be in a stretched state during embroidery. Similarly, the embodiment described above with a window 126 (see the support device 104 of FIG. 2) may provide support/tension to the textile component along the entire length of the support device 104.

Figure 8:
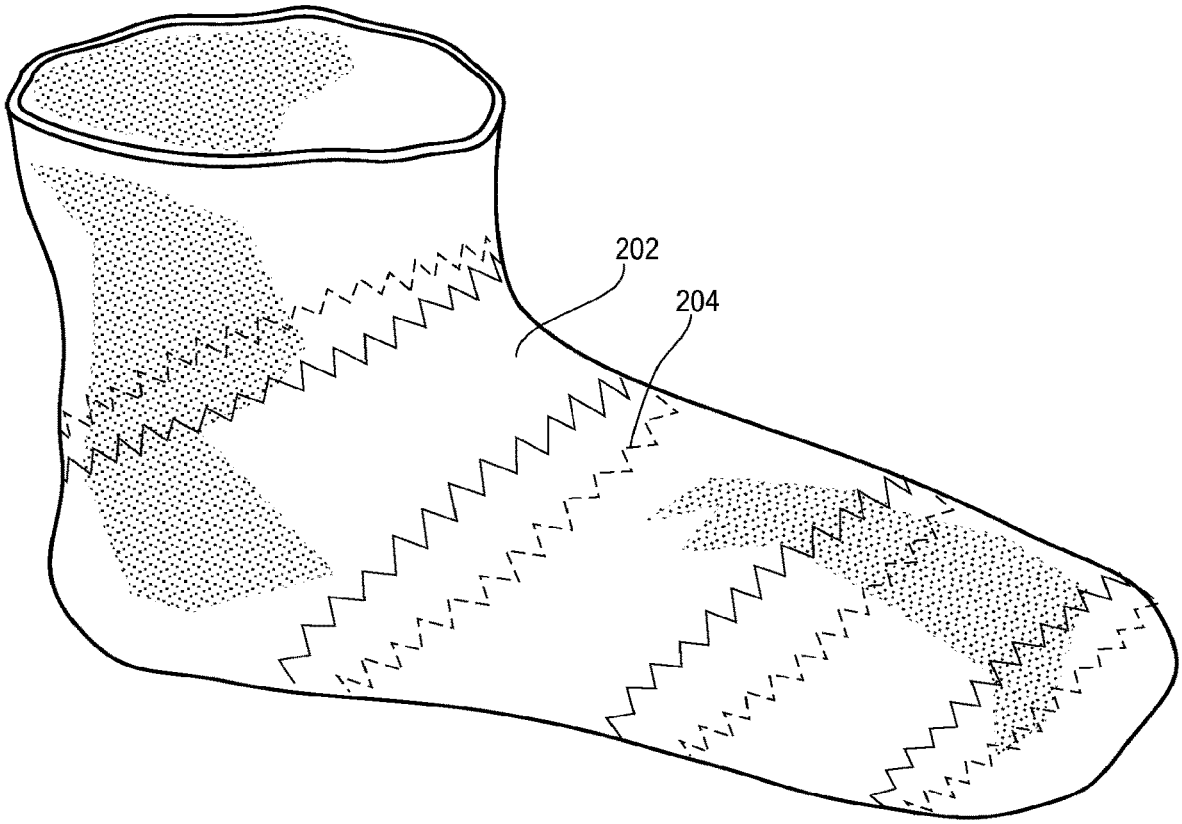
FIG. 8 is an illustration showing a textile component with an embroidered strand in accordance with certain aspects of the present disclosure.

FIG. 8 is an illustration showing the textile component 202 with the embroidered strand 204 after being removed from the above-described assembly. As shown, the embroidered strand 204 may extend at least 360 degrees around the tubular construction of the textile component 202. The embroidered strand 204 may be advantageous not only for its aesthetics, but it also may provide the textile component with desirable physical properties, such as a desired rigidity, selected stretchability (which may vary in different directions), etc. Several embodiments and several associated advantages of an embroidered textile component are described in detail in U.S. patent application Ser. No. 15/591,686, published as U.S. Patent Publication No. 2017/0327985, which is herein incorporated by reference in its entirety. The assembly 102 described above makes this 360 degree extension of an embroidered strand 204 on a textile component possible without significantly increasing the manufacturing burden. Notably, the above-described embodiments may enable formation of the textile component 202 using conventional embroidery needles and conventional embroidery processes without substantial modification of the embroidery needle and/or machine.

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. An assembly, comprising:

a support device having a surface for receiving a textile component, wherein, when the textile component is received by the surface of the support device, the surface contacts an inner surface of the textile component;

an actuation device, the actuation device having an actuation outer surface that at least partially surrounds the support device and an actuation inner surface; and a top shaft and a bottom shaft, wherein translational movement of the top shaft transitions the actuation device between an engaged state and an open state, wherein the bottom shaft is mechanically coupled to the actuation inner surface, wherein the bottom shaft is driven via a motor and has a fixed translational position, wherein the actuation outer surface is movable with respect to the surface of the support device such that, when the textile component is held by the support device, movement of the actuation outer surface with respect to the surface of the support device causes rotational movement of the textile component with respect to the surface of the support device.

2. The assembly of claim 1, wherein the support device includes a window defining a cavity, and wherein the surface of the support device at least partially surrounds the cavity.

3. The assembly of claim 1, wherein the support device is fixed in place with respect to an embroidery machine comprising an embroidery needle and wherein the support device is in communication with the embroidery needle.

4. The assembly of claim 1, wherein the actuation device includes a belt, and wherein a first face of the belt defines at least part of the actuation outer surface.

5. The assembly of claim 4, further comprising a second belt with a second actuation outer surface.

6. The assembly of claim 4, wherein the belt has a second face opposite the first face, and wherein the second face includes a plurality of grooves.

7. The assembly of claim 1, wherein the support device is movable from a position engageable with an embroidery machine to another position engageable with a second machine.

8. The assembly of claim 7, wherein the second machine is operable to provide a process or an operation other than embroidery.

9. The assembly of claim 1, wherein the textile component rotatably moves along the surface of the support device when movement of the actuation outer surface is causing rotational movement of the textile component.

10. An assembly, comprising:

a support device, the support device having an outer surface and a cylindrical shape;

an actuation device, the actuation device having at least one belt defining an actuation outer surface that is movable with respect to the outer surface of the support device in a first rotational direction and a second rotational direction that is opposite the first rotational direction, and an actuation inner surface; and a first shaft and a second shaft, wherein translational movement of the first shaft transitions the actuation device between an engaged state and an open state, wherein the second shaft is mechanically coupled to the actuation inner surface, wherein the second shaft is driven via a motor, wherein the second shaft has a same position when the actuation device is in the engaged state or the open state, wherein the actuation outer surface at least partially surrounds the support device when the actuation device is in the engaged state, and wherein at least a portion of the actuation outer surface moves away from the support device when the actuation device is transitioning from the engaged state to the open state.

11. The assembly of claim 10, wherein the support device includes an opening providing access to a cavity of the support device, and wherein the outer surface of the support device at least partially surrounds the cavity.

12. The assembly of claim 11, wherein the support device is fixed in place with respect to an embroidery machine for communication with an embroidery needle.

13. The assembly of claim 10, wherein rotation of the first shaft causes the actuation outer surface to move.

14. The assembly of claim 10, further comprising a second belt with a second actuation outer surface that at least partially surrounds the support device when the actuation device is in the engaged state.

15. The assembly of claim 10, wherein the first shaft has a first position corresponding to the open state of the actuation device and a second position corresponding to the engaged state of the actuation device.

16. The assembly of claim 15, wherein, when the first shaft is moving from the first position to the second position, the first shaft moves upwardly and inwardly with respect to the support device.

17. The assembly of claim 15 further comprising a third shaft and a fourth shaft, wherein the third shaft has a third position corresponding to the open state of the actuation device and a fourth position corresponding to the engaged state of the actuation device, and wherein the fourth shaft has a same position when the actuation device is in the engaged state or the open state.

* * * * *